United States Patent [19]

Schmidt

[11] 4,429,879

[45] Feb. 7, 1984

[54] SOLE PLATE INTERNAL SUSPENSION IN METAL SHELLS TO FORM METAL WOODS

[76] Inventor: Glenn H. Schmidt, 1857 Los Encinos, Glendale, Calif. 91208

[21] Appl. No.: 365,148

[22] Filed: Apr. 5, 1982

[51] Int. Cl.[3] ..... A63B 53/04

[52] U.S. Cl. ..... 273/167 H

[58] Field of Search ..... 273/167–175

[56] References Cited

U.S. PATENT DOCUMENTS 1,526,438 2/1925 Scott ..... 273/174 X 4,214,754 7/1980 Zebelean ..... 273/167 H

*Primary Examiner*—Richard J. Apley

*Attorney, Agent, or Firm*—William W. Haefliger

[57] ABSTRACT

Ledge structure is made integral with a hollow metallic golf club head, to position a metallic sole plate that closes an opening in the bottom wall of the shell. The ledge structure is defined by multiple ledges spaced apart about that opening and in pairs at opposite sides of an upright plane that bisects the head in a front to rear direction. At least two of the ledges are defined by the lower terminals of ribs integrally formed with the head front wall. The ledges are spaced from the outer surface of the bottom wall so that the sole plate outer surface is flush with the outer surface of the head bottom wall; and the sole plate periphery is connected to the rim of the opening in that bottom wall by weld material in the space between that rim and the sole plate periphery.

4 Claims, 7 Drawing Figures

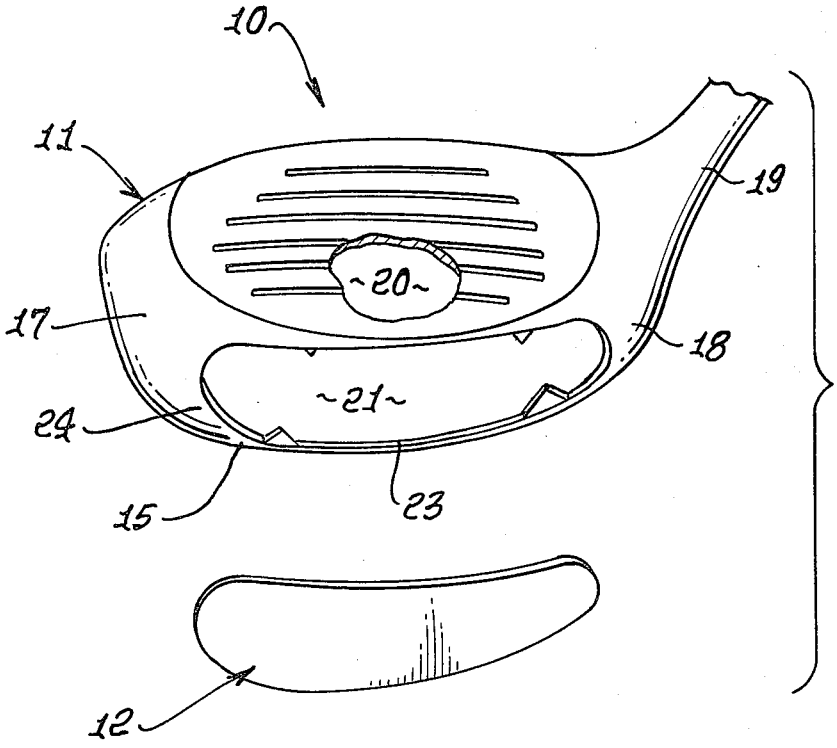
FIG. 1.
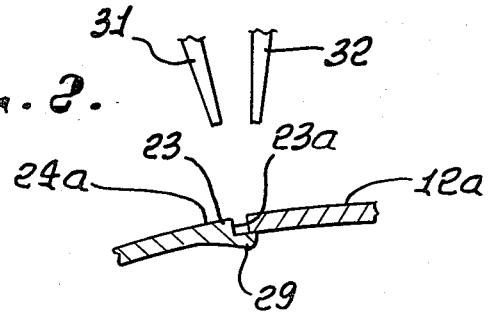
FIG. 2.
FIG. 6.
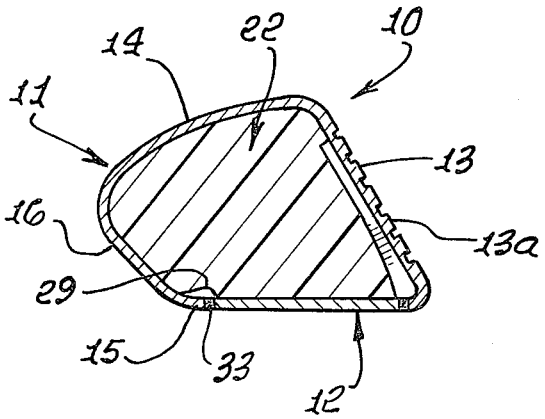
FIG. 2a.
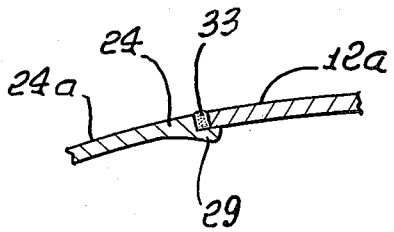

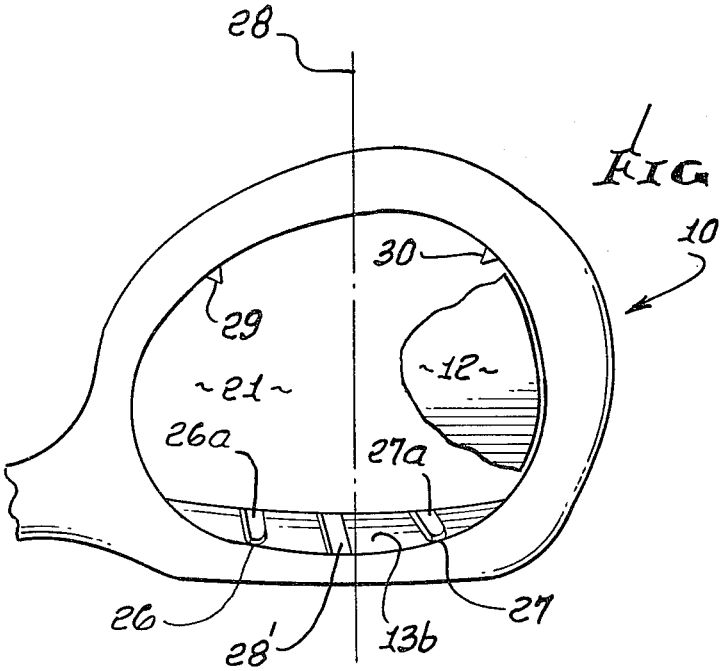
FIG. 3.
FIG. 4.
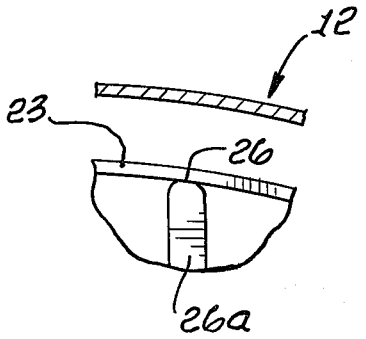
FIG. 5.
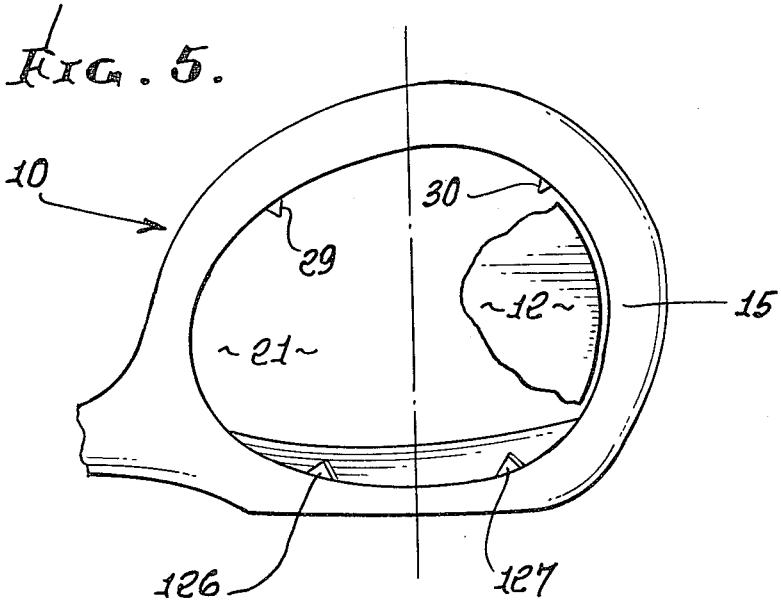

SOLE PLATE INTERNAL SUSPENSION IN METAL SHELLS TO FORM METAL WOODS

BACKGROUND OF THE INVENTION

This invention relates generally to fabrication of metallic, hollow golf club heads (woods). More particularly, it concerns the support of metallic sole plates on head shells as during their interconnection.

During fabrication of golf club metal heads (woods) of hollow configuration, an opening is formed in the bottom wall of the head. That opening is typically covered or filled by attachment of a sole plate to the rim bounding the opening. The opening results from the lost wax process of fabrication, wherein metal core parts are removed from the wax shell via the precursor opening in that shell.

It has been proposed to support the metal sole plate in the opening formed by the metal shell, as by employing tabs on the sole plate, whereby the weld connection can then be accomplished; however, such tabs must then be removed as by grinding. Also, such tabs formed on the precursor wax "sole plate" are disadvantageously subject to unwanted break-off due to their weak support on that plate.

SUMMARY OF THE INVENTION

It is a major object of the invention to provide method and product overcoming the above problems and disadvantages. Basically, the method of the invention includes:

(a) forming ledge structure integrally with the shell and adjacent a rim bounding the opening by locating the ledge structure in the hollow of the shell, in offset relation to the rim, (b) placing the sole plate in said opening and supported on said ledge structure, with close peripheral spacing from said rim, (c) and connecting the sole plate at its periphery to the shell.

As will appear, multiple, small sized ledges are typically formed or spaced about the opening to so as not to obstruct removal of core parts from the precursor wax shell; at least two such ledges may be located proximate the front wall of the shell or head, and at least two such ledges may be located rearwardly across the opening and adjacent a rear rim portion of the shell bottom wall. Further, the ledges may have triangular or outwardly convex shape, with advantages to be described.

In its apparatus or product aspects, the invention comprises:

(a) ledge structure integral with the shell and adjacent a rim formed by said opening so that the ledge structure is in the shell hollow, in offset relation to the rim, (b) the sole plate located in said opening and supported on said ledge structure to have close peripheral spacing from the rim, and (c) the sole plate connected to the shell rim.

These and other objects and advantages of the invention, as well as the details of an illustrative embodiment, will be more fully understood from the following specification and drawings, in which:

DRAWING DESCRIPTION

FIG. 1 is a perspective, exploded view of the front face and underside of a metal golf club head, with a thin sole plate separated from the head shell;

FIG. 2 is an enlarged fragmentary view showing a portion of a sole plate supported on a ledge integral with the shell;

FIG. 2*a* is a view like FIG. 2 showing the ledge supported sole plate, after welding connection to the shell;

FIG. 3 is a bottom plan view of the FIG. 1 head, with the sole plate partly broken away;

FIG. 4 is an enlarged, fragmentary, and exploded frontal view of a shell ledge and sole plate;

FIG. 5 is a view like FIG. 3, showing a modification; and

FIG. 6 is a cross section taken in elevation through a completed head incoporating the invention.

DETAILED DESCRIPTION

In the drawings, the golf club head 10 comprises a thin metallic shell 11 and a thin metallic sole plate 12. Preferably these elements comprise steel. The shell includes a front wall 13 having a front face 13*a* adapted to strike a golf ball, thin top and bottom walls 14 and 15, and rear wall 16. Also, the head includes a toe portion 17, and a heel portion 18. A hosel appears at 19. The shell defines a hollow interior 20, and prior to attachment of the sole plate to the shell, the interior opens at 21 to the exterior. One reason for that opening is to allow for removal of core structure during the fabrication of the hollow shell as by the lost wax process. The hollow interior is ultimately filled with foamed plastic material (which may consist of polyurethane) as seen at 22 in FIG. 6.

The invention concerns forming ledge structure integrally with the shell and adjacent a rim bounding the opening 21, by locating the ledge structure in the hollow of the shell, in offset relation in the rim. FIGS. 1, 2 and 2*a* show loop shaped rim 23 formed by shell bottom wall lip 24 bounding opening 21.

The ledge structure is typically formed to define multiple ledges spaced about opening 21. Of particular advantage from a ledge weight distribution standpoint, is the formation of the ledges to have the shapes and locations as shown in FIGS. 1–4. Thus, two like ledges 26 and 27 are located proximate the front wall 13, and at approximately equal distances from a front to rear upright plane 28 bisecting the head. Ledges 26 and 27 may have outwardly convex or rounded surfaces (see FIGS. 3 and 4) to support the sole plate. Further, they may be formed at the lower ends of ribs 26*a* and 27*a* which are formed integrally with the inner side 13*b* of wall 13 to strengthen that wall for resisting golf ball impact. A third rib appears at 28.

In addition, two like ledges 29 and 30 are located proximate a rim portion 23*a* of the opening spaced rearwardly of the front wall, and across the opening 21 therefrom. Ledges 29 and 30 have triangular configuration facing outwardly of the opening 21, proximate the rim portion 23*a*. See also FIG. 2. The triangular configuration of the ledges provides minimum weight addition to the metal head, with maximum strength to resist breakage, as during the wax precursor stage wherein metallic core parts are removed through opening 21 and can engage the wax ledges (precursors to ledges 26, 27, 29 and 30). Ledges 29 and 30 are likewise preferably located at approximately equal distances from and at opposite sides of plane 28.

FIG. 2 also shows welding rods or equipment 31 and 32 positioned to weld connect the sole plate to the shell rim 23. FIG. 2*a* shows a typical weld 33, filling the slight gap between the rim 23 and the boundary of the sole plate. The spacing of the ledges from the outer surface 24*a* of the lip 24 is such as to locate the sole plate surface 12*a* flush with surface 24*a*, as seen in FIG. 2*a*, during such welding. Also, the ledges are then concealed, and need not be removed.

FIG. 5 is like FIG. 3 in all respects, excepting that the ledges 126 and 127 (corresponding to ledges 26 and 27) have triangular configuration to resemble ledges 29 and 30.

I claim:

1. A golf club head having a hollow metal shell defining a front wall, a bottom wall, and top and back sides, said bottom wall having an opening therein, a metallic sole plate attached to said bottom wall thereby closing said opening and forming a hollow golf club head, the combination comprising:

(a) ledge structure integral with the shell and adjacent a rim formed by said opening so that the ledge structure is in the shell hollow, in offset relation to the rim, said ledge structure defined by multiple ledges spaced about said opening and spaced apart from one another, and projecting toward the central region of said opening, said ledges spaced apart in pairs at opposite sides of an upright plane bisecting the head in a front to rear direction, (b) the sole plate located in said opening and supported solely by portions of said ledges spaced from said rim to have close peripheral spacing from the rim, (c) the sole plate being peripherally connected to the shell rim by weld material which fills the spaces between the sole plate and the rim and engages said ledges, (d) upright ribs integrally formed with said front wall, at least a first two of said ledges defined by the lower terminals of said ribs, and (e) said ledges spaced from the outer surface of said bottom wall and toward the hollow interior of the shell so that the sole plate outer surface is flush with said bottom wall outer surface.

2. The combination of claim 1 wherein at least two ledges are located proximate a rim portion of the shell spaced rearwardly of said front wall, across said opening.

3. The combination of one of claims 1 and 2 wherein at least two of the ledges have triangular configuration facing outwardly of the opening.

4. The combination of one of claims 1, 2 and 3 wherein at least two of the ledges have convex configuration facing outwardly of the opening proximate the rim portion.

* * * * *